US005525860A

United States Patent [19]

Horaguchi et al.

[11] Patent Number: 5,525,860

[45] Date of Patent: Jun. 11, 1996

[54] PLANT GROWING 4 PHOSPHOR FLUORESCENT LAMP HAVING A PHOTON FLUX RATIO OF FROM 0.8 TO 1.0 FOR LIGHT IN THE 600 NM-700 NM AND 700 NM-800 NM BANDS

[75] Inventors: Kimitoshi Horaguchi, Sakai; Masaaki Morita, Hirakata; Haruo Shibata, Takatsuki; Katsusuke Murakami, Amagasaki; Ichiro Aiga, Sakai, all of Japan

[73] Assignee: Matsushita Electric Industrial Co., Ltd., Osaka, Japan

[21] Appl. No.: 330,836

[22] Filed: Oct. 27, 1994

Related U.S. Application Data

[63] Continuation of Ser. No. 13,067, Feb. 3, 1993, abandoned.

[30] Foreign Application Priority Data

Feb. 7, 1992 [JP] Japan ..... 4-021526

[51] Int. Cl.[6] ..... H01J 1/62; H01J 63/04

[52] U.S. Cl. ..... 313/486; 313/487; 47/DIG. 6

[58] Field of Search ..... 313/110, 112, 313/486, 487, 572; 47/DIG. 6

[56] References Cited

U.S. PATENT DOCUMENTS

| | | | |
|---|---|---|---|
| 3,287,586 | 11/1966 | Bickford | 313/109 |
| 3,352,058 | 11/1967 | Brant | 47/DIG. 6 |
| 3,857,054 | 12/1974 | Lehmann et al. | 313/486 |
| 3,992,646 | 11/1976 | Corth | 313/487 |
| 4,371,810 | 2/1983 | Corth | 313/487 |
| 5,028,839 | 7/1991 | Abeywickrama et al. | 313/486 |
| 5,269,093 | 12/1993 | Horaguchi et al. | 47/DIG. 6 |

FOREIGN PATENT DOCUMENTS 2-60525 3/1990 Japan .

OTHER PUBLICATIONS

Kimitoshi Horaguchi, et al, "4–Band Fluorescent Lamp for Plant Growth", National Technical Report, vol. 38, No. 6, Dec. 1992, pp. 627–634.

Smith et al, "The Function of Phytochrome in the Natural Environment–III. Measurement and Calculation of Phytochrome Photoequilibria", Photochemistry and Photobiology, vol. 25, 1977 pp. 547–550.

Morgan, et al "Linear Relationship Between Phytochrome Photoequilibrium and Growth in Plants Under Simulated Natural Radiation", Nature, vol. 262, Jul. 15, 1976, pp. 210–212.

Murakami, et al, "Fundamental Studies in the Development of New Fluorescent Lamps for Plant Growth", Acta Horticulturae 319, 1992, pp. 329–334.

*Primary Examiner*—Anita Pellman Gross
*Assistant Examiner*—Walter J. Malinowski
*Attorney, Agent, or Firm*—Stevens, Davis, Miller & Mosher

[57] ABSTRACT

The invention provides a fluorescent lamp for plant growth capable of controlling morphology in terms of grass height, area and shape of leaves and so forth, approximating those obtained under natural daylight, while effectively promoting photosynthesis of the plant. The fluorescent lamp has a glass tube and a fluorescent layer formed on the inner surface of the tube and composed of four fluorescent components having light emission peaks in the bands of 440 to 460 nm, 540 to 560 nm, 600 to 620 nm and 700 to 800 nm, respectively, said fluorescent layer having the PF ratio ranging from 0.8 to 1.2 in terms of the ratio between the photon flux PF contained in the wavelength band of 600 to 700 nm to that in the wavelength zone of 700 to 800 nm. According to the invention, the spectral characteristic of the fluorescent lamp is so selected that light in the wavelength band of 700 to 800 nm, which influences the morphology of the plant and elongation of the plant, in addition to the light in the wavelength band of 400 to 700 nm, which is effective in photosynthesis, is applied to the plant so as to attain growth substantially equivalent to that obtained under the natural light.

3 Claims, 3 Drawing Sheets

PLANT GROWING 4 PHOSPHOR FLUORESCENT LAMP HAVING A PHOTON FLUX RATIO OF FROM 0.8 TO 1.0 FOR LIGHT IN THE 600 NM-700 NM AND 700 NM-800 NM BANDS

This application is a continuation of application Ser. No. 08/013,067, filed Feb. 3, 1993 (abandoned).

BACKGROUND OF THE INVENTION

Field of the Invention

In recent years, research and development, as well as application to practical use, have been vigorously conducted in regard to bio-nursery for growing elite seeds and new spices by using bio-technologies such as tissue culture, cell fusion and gene recombination, as well as on plant factories intended for stably producing various pants with high product quality under an artificial environment which is free from natural conditions. A bio-nursery and a plant factory essentially require that light necessary for growing plants supplied from an artificial light source. Hitherto, lamps such as fluorescent lamps and BID lamps, e.g., metal halide lamps, high-pressure sodium lamps, have been used independently or in combination as the artificial light source. Among these lamps, fluorescent lamps are easy to handle and capable of being placed in close proximity to the object plants to satisfactorily illuminate the lamp. In addition, although the fluorescent lamps have been considered as being unsuitable as light sources for plant growth due to small light output per unit lamp as compared with BID lamps, compact fluorescent lamps having high output power have been developed. For these reasons, fluorescent lamps are nowadays expected to be one of the prominent artificial light sources for growing plants.

A fluorescent lamp for plant growth has been known which has two components: namely, a red fluorescent component and blue fluorescent component. The light emitting spectrum of this type of fluorescent lamp resembles that of the chlorophyll bio-synthetic action spectrum of plants. Typically, magnesium fluorogermanate activated with manganese is used as the red fluorescent component, while calcium tungstate is used as the blue fluorescent component.

Morphology of plants is a very important factor, particularly when the plants of high quality and high commercial value are to be produced. The elongation growth which largely affects the morphology of a plant is closely related to ratio of photon fluxes contained in two wavelength bands which are centered at 660 nm and 730 nm, i.e., the ratio between the photon flux included in the wavelength band of 600 to 700 nm and that in the wavelength band of 700 to 800 nm, represented by $PF_{600-700}/PF_{700-800}$. When this value is large, the internode elongation of the plant is suppressed to cause a dwarf tendency of the plant, whereas, when this ratio is large, the elongation is promoted. Actually, however, the conventional fluorescent lamps for plant growth substantially lack the light in the wavelength band of 700 to 800 nm, as shown in FIG. 2. In addition, since the fluorescent lamp for plant growth is designed to have such characteristics that the light is abundant in the wavelength band between 600 and 700 nm (see Table 1) so as to approximate the bio-synthetic curve of chlorophyll, the aforesaid ratio $PF_{600-700}/PF_{700-800}$ of such lamp is 16.9, which is much greater than that, 1.1, of the natural light (standard daylight $D_{65}$).

TABLE 1

| Light source | PPF per lamp input (relative value) | $PF_{600-700}/PF_{700-800}$ |
|---|---|---|
| Standard daylight ($D_{65}$) | 556 | 1.1 |
| Incandescent lamp | 100 | 0.7 |
| Fluorescent lamp for plant growth (PG type) | 243 | 16.9 |
| Three band fluorescent lamp | 422 | 10.8 |

Therefore, the plants grown under the light of conventional fluorescent lamps for plant growth suffer from suppression in the internode elongation and growth of the veins, thus causing dwarfing of the plants. Furthermore, as shown in FIG. 3, other ordinary illuminating fluorescent lamps, e.g., three band fluorescent lamp, substantially lack light in the wavelength band of 700 to 800 nm, so that the aforesaid ratio $PF_{600-700}/PF_{700-800}$ is as large as 10.8, thus enhancing the dwarf tendency of the plant. It is also to be pointed out that, as shown in FIG. 2, the conventional fluorescent lamp for plant growth has a smaller amount of photosynthetic photon flux than three band fluorescent lamps in the wavelength band of 400 to 700 nm which is effective in photosynthesis.

An object of the present invention is to provide a fluorescent lamp for plant growth which is effective in growing plants similar to those grown under natural daylight in terms of morphology, i.e., height, leaf shape and size and so forth, and which effectively promotes photosynthesis.

To this end, according to the present invention, there is provided a fluorescent lamp, comprising: a glass tube; and a fluorescent layer composed of three fluorescent components having light emission peaks in the bands of 440 to 460 nm, 540 to 560 nm and 600 to 620 nm, respectively, and a far-red emission fluorescent component having peak of light emission in the wavelength band of 700 to 800 nm, the fluorescent layer having the PF ratio ranging from 0.8 to 1.2 in terms of the ratio between the photon flux PF contained in the wavelength band of 600 to 700 nm to that in the wavelength zone of 700 to 800 nm, covering the PF ratio of natural daylight ($D_{65}$) which is 1.1.

According to the invention, a high photosynthesis promotion effect can be attained by using, as the fluorescent component which emits light of wavelength band of 400 to 700 nm which is effective in photosynthesis, by virtue of the use of a three band fluorescent lamp which has three types of fluorescent components activated by rare earth metals and which exhibits the highest emission efficiency among the fluorescent lamps. Furthermore, according to the present invention, a fluorescent component is used which emits far-red rays of a wavelength band of 700 to 800 nm effective in the control of plant morphology, and the ratio of the PF between the PF contained in the wavelength band of 600 to 700 nm and that contained in the wavelength band of 700 to 800 nm is determined to range between 0.8 and 1.2. Owing to these features, the present invention makes it possible to efficiently produce plants of high quality, while attaining plant morphology similar to that obtained under natural light, in terms of the height, shape and size of leaves, and so forth.

DESCRIPTION OF THE PREFERRED EMBODIMENT

Figure 1:
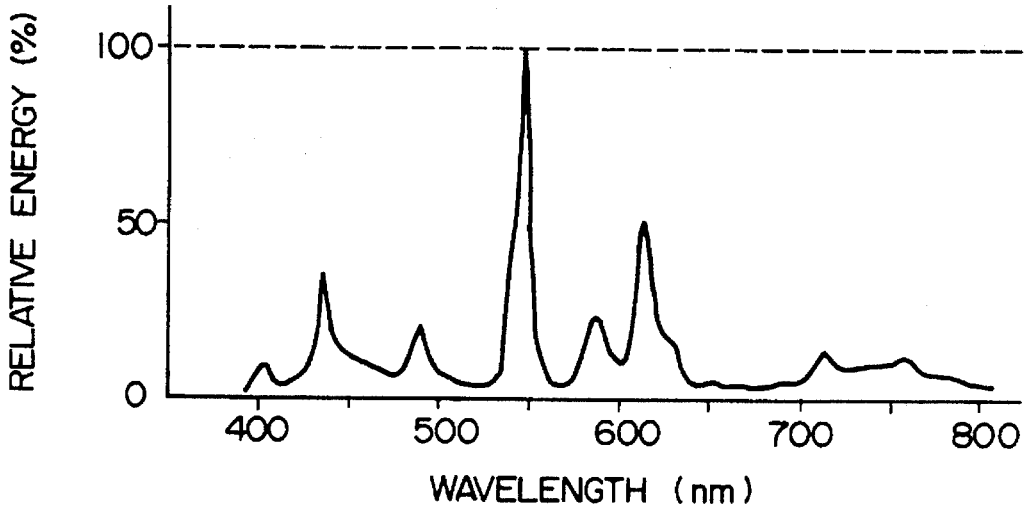
FIG. 1 is a spectral distribution chart showing the characteristics of an embodiment of the fluorescent lamp in accordance with the present invention.
Figure 2:
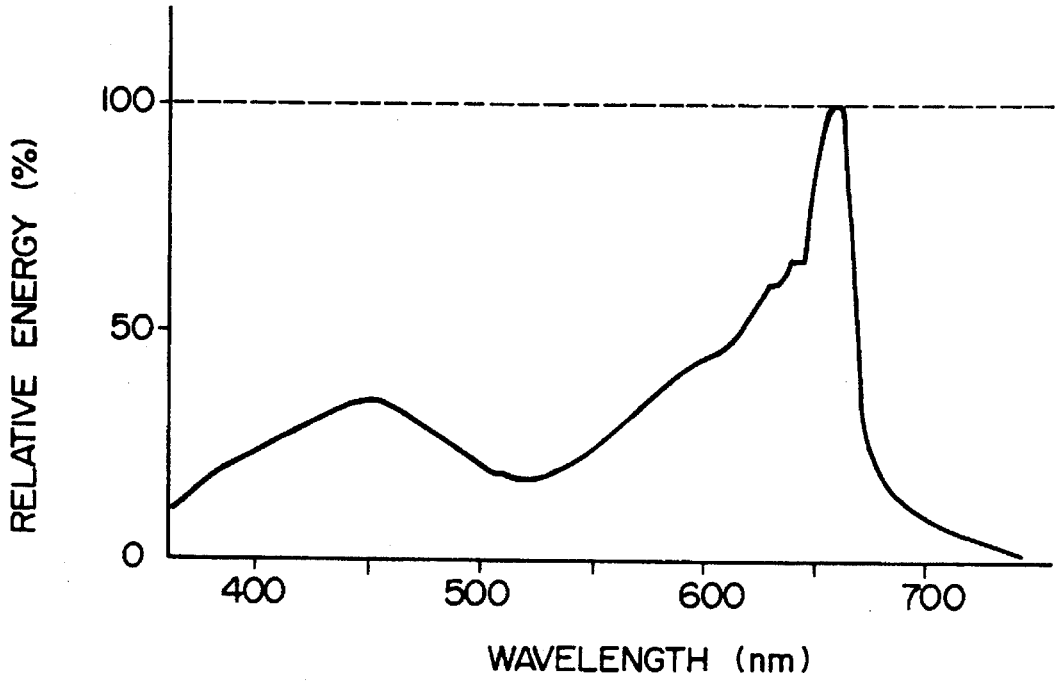
FIG. 2 is a spectral distribution chart illustrative of the characteristic of a known fluorescent lamp for plant growth.
Figure 3:
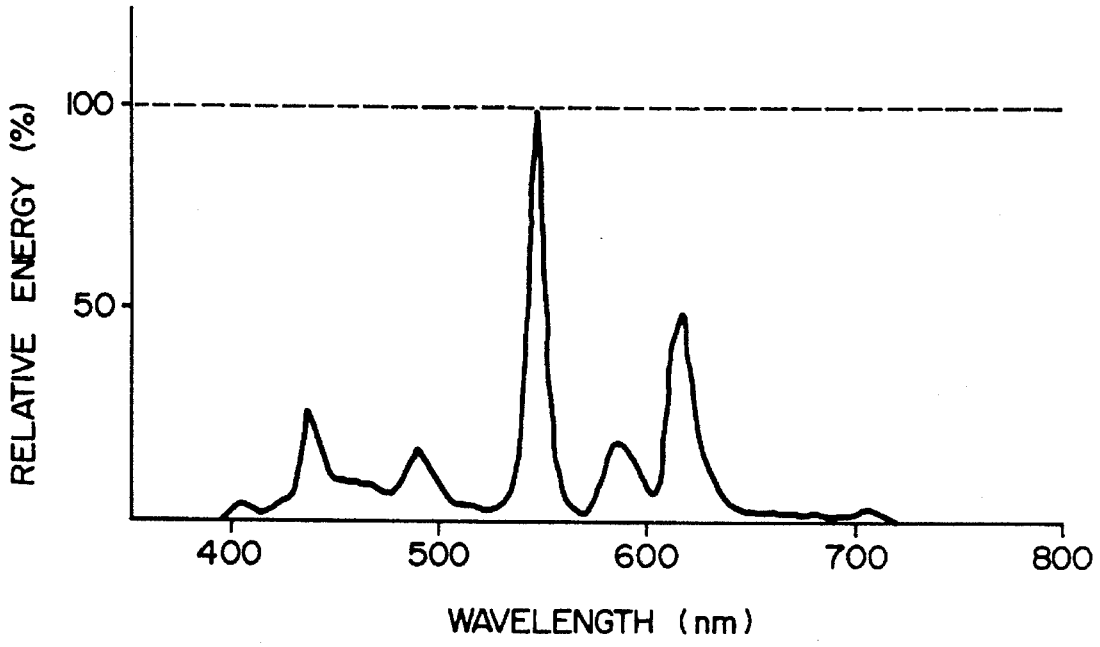
FIG. 3 is a spectral distribution chart illustrative of the characteristic of a three band fluorescent lamp.

A description will now be given of a preferred embodiment of the present invention. Barium aluminate magnesium (BAM) activated with bivalent europium is used as the fluorescent component which emits in the wavelength region of 440 to 460 nm. Lanthanum phosphate (LAP) activated with cerium and terbium is used as the fluorescent component which emits light in the wavelength band of 540 to 560 nm. Yttrium oxide (YOX) activated with trivalent europium is used as the fluorescent component which emits light in the wavelength band of 600–620 nm. Finally, lithium aluminate (ALF) activated with iron is used as a fluorescent component which emits light in the wavelength band of 700 to 800 nm. With these fluorescent components, a fluorescent suspension liquid is formed at a weight ratio of BAM 16%, LAP 32%, YOX 32% and ALF 20%. A fluorescent layer is formed on the inner wall surface of a glass tube by an ordinary method using this fluorescent suspension liquid, thus obtaining a compact 55 Watt fluorescent lamp. The spectral distribution characteristic of the thus obtained fluorescent lamp is shown in FIG. 1.

In a walk-in type growth cabinet which is air-conditioned to maintain air of 25° C. and relative humidity of 70% with $CO_2$ concentration of 300 ppm, four plant cultivation zones were defined which employ, respectively, a fluorescent lamp embodying the present invention, a standard daylight light source, a conventional fluorescent lamp for plant growth and three band fluorescent lamp, as the light sources. In each such cultivate zones, the light intensity on the culture surface was set to a level of 200 $\mu mol.m^{-2}.S^{-1}$ in terms of photosynthetic photon flux density (photon flux density in wavelength band of 400 to 700 nm, PPFD), and seedlings of sunflowers were water-cultured in a rock wool culture. The state of growth in each zone was examined and studied. The photosynthetically effective photon flux density in the photon environment of each plant cultivation zone, together with the ratio of the photon flux density $PF_{600-700}$ contained in the wavelength band of 600 to 700 nm to that $PF_{700-800}$ contained in the wavelength band of 700 to 800 nm, is shown in Table 2. In the case of the illustrated embodiment, the above-mentioned ratio was 1.2.

TABLE 2

| Types of light source | Photosynthetically effective photon flux density PPFD ($\mu \cdot m^{-2} \cdot S^{-1}$) | Photon flux density ratio $PPF_{600-700}/PPF_{600-700}$ |
|---|---|---|
| Fluorescent lamp of embodiment | 200 | 1.2 |
| Standard daylight lightsource | 200 | 1.1 |
| Fluorescent lamp for plant growth (PG type) | 200 | 16.9 |
| Three band fluorescent lamp | 200 | 10.8 |

Seeds of sunflowers, homogeneity of which has been genetically assured, were used in the experiment. The seeds were dipped in water for 24 hours so as to bud and to sufficiently develop the cotyledon. Homogeneous seedlings, obtained 8 days after the inoculation, with third and fourth leaves being developed, were extracted so as to be used as test plants. The sunflower seedlings, as the test plants as selected as above, were grafted to the aforesaid four culture zones which employ different types of light sources under the same air conditions in terms of the air temperature, relative humidity, $CO_2$ density and photosynthetic photon flux density, and were cultured in the rock wool cultures of the respective culture zones. Table 3 shows the states of growth of the test plants as observed 8 days after the grafting to these culture zones.

TABLE 3

| Types of light source | Fresh weight (g) | Dry weight (g) | Grass height (cm) | Grass area ($cm^2$) |
|---|---|---|---|---|
| Fluorescent lamp of embodiment | 14.0 | 1.5 | 19.1 | 312.3 |
| Standard daylight light source | 14.8 | 1.6 | 19.3 | 308.0 |
| Fluorescent lamp (PG type) | 9.0 | 1.0 | 8.3 | 205.2 |
| Three band fluorescent lamp | 8.8 | 0.9 | 8.1 | 199.7 |

The test plants grown in the culture zone employing the fluorescent lamp of this embodiment, as well as the culture zone under the natural light, showed greater weight those of the other culture zones in terms of both fresh and dry weights. As to the plant morphology, the test plants in the culture zone using the conventional fluorescent lamp for plant growth and the test plant in the culture zone using the three band fluorescent lamp, showed grass height and leaf area which are respectively about 40% and about 65% smaller than those obtained in the culture zone employing the standard daylight light source. In contrast, the test plant grown in the culture zone employing the fluorescent lamp in accordance with this embodiment showed results substantially equivalent to those obtained in the culture zone illuminated by the natural daylight light source.

As will be understood from the foregoing description, the fluorescent layer has a composition of BAM 16%, LAP 32%, YOX 32% and ALF 20% in terms of weight ratio, and exhibits the PF ratio of 1.2. This, however, is only illustrative, and the fluorescent layer can have a composition of BAM 13%,LAP 26%, YOX 26% and ALF 35% in terms of weight ratio, with the PF ratio value of 1.0, or a composition of BAM 10%, LAP 20%, YOX 20% and ALF 50% in terms of weight ratio, with the PF ratio of 0.8, as shown in Table 4. It is therefore possible to obtain a plant growing fluorescent lamp in accordance with the present invention, by selecting the contents of the respective fluorescent components so as to make the PF ratio value fall within the range of from 0.8 to 1.2.

TABLE 4

| | BAM | LAP | YOX | ALF | $PPF_{600-700}/PPF_{700-800}$ |
|---|---|---|---|---|---|
| Embodiment 1 | 16% | 32% | 32% | 20% | 1.2 |
| Embodiment 2 | 13% | 26% | 26% | 35% | 1.0 |
| Embodiment 3 | 10% | 20% | 20% | 50% | 0.8 |

Figure 4:
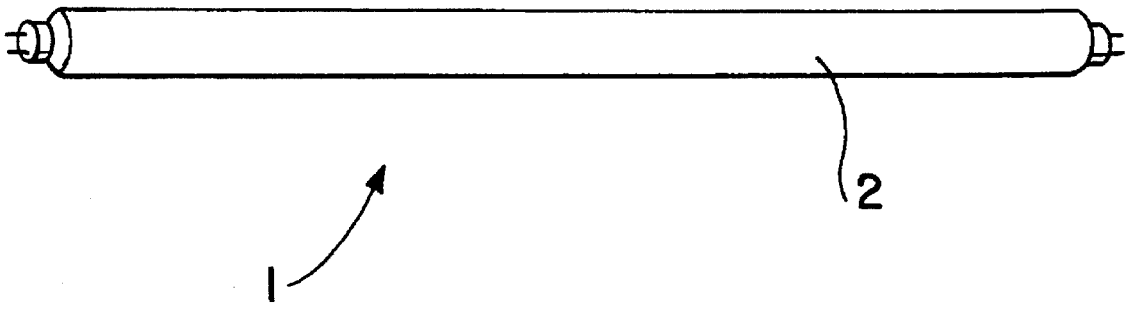
FIG. 4 is a view of a fluorescent lamp having a fluorescent layer in accordance with the present invention.
Figure 5:
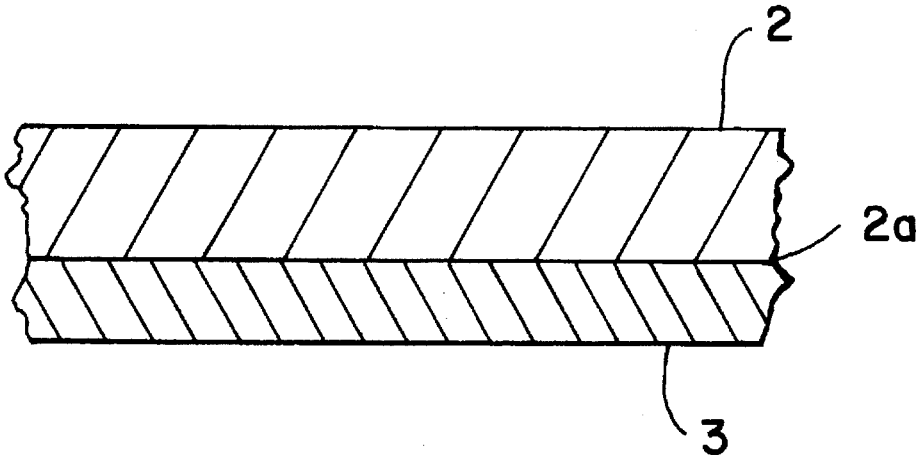
FIG. 5 is a cut-away view of a portion of the fluorescent lamp shown in FIG. 4.

The physical structure of an embodiment of a fluorescent lamp in accordance with the present invention will now be described with reference to FIGS. 4 and 5. As shown in FIG. 4, fluorescent lamp 1 includes tube 2, which is preferably a glass tube. FIG. 5 shows a cut-away view of a portion of fluorescent lamp 1. As shown in FIG. 5, tube 2 has inner surface 2*a*, on which is formed fluorescent layer 3 in accordance with the present invention, whose composition has been described above.

As will be understood from the foregoing description, according to the present invention, there is provided a fluorescent lamp, comprising: a glass tube; and a fluorescent layer composed of three fluorescent components having light emission peaks in the bands of 440 to 460 nm, 540 to 560 nm and 600 to 620 nm, respectively; and a far-red emission fluorescent component having peak of light emission in the wavelength band of 700 to 800 nm, the fluorescent layer having the PF ratio ranging from 0.8 to 1.2 in terms of the ratio between the photon flux PF contained in the wavelength band of 600 to 700 nm to that in the wavelength zone of 700 to 800 nm. By virtue of these features, the present invention makes it possible to promote photosynthesis and to attain a plant morphology similar to that obtained under natural daylight in terms of grass height, leaf shape and size, thus enabling efficient growth of plants with high quality.

We claim:

1. A fluorescent lamp, comprising:

a tube having an inner surface; and a fluorescent layer formed on the inner surface of the tube and comprising four fluorescent components having light emission peaks in bands of 440 to 460 nm, 540 to 560 nm, 600 to 620 nm and 700 to 800 nm, respectively, said fluorescent layer having a photon flux (PF) ratio ranging from 0.8 to 1.2, wherein the PF ratio is a ratio between a photon flux PF contained in the wavelength band of 600 to 700 nm to a photon flux PF contained in the wavelength zone of 700 to 800 nm, wherein the fluorescent component which emits in the wavelength region of 440 to 460 nm comprises barium aluminate magnesium (BAM) activated with bivalent europium, the fluorescent component which emits light in the wavelength band of 540 to 560 nm comprises lanthanum phosphate (LAP) activated with cerium and terbium, the fluorescent component which emits light in the wavelength band of 600 to 620 nm comprises yttrium oxide (YOX) activated with trivalent europium, and the fluorescent component which emits light in the wavelength band of 700 to 800 nm comprises lithium aluminate (ALF) activated with iron, wherein the fluorescent layer has a composition of 13% by weight BAM, 26% by weight LAP, 26% by weight YOX and 35% by weight ALF.

2. A fluorescent lamp, comprising:

a tube having an inner surface; and a fluorescent layer formed on the inner surface of the tube and comprising four fluorescent components having light emission peaks in bands of 440 to 460 nm, 540 to 560 nm, 600 to 620 nm and 700 to 800 nm, respectively, said fluorescent layer having a photon flux (PF) ratio ranging from 0.8 to 1.2, wherein the PF ratio is a ratio between a photon flux PF contained in the wavelength band of 600 to 700 nm to a photon flux PF contained in the wavelength zone of 700 to 800 nm, wherein the fluorescent component which emits in the wavelength region of 440 to 460 nm comprises barium aluminate magnesium (BAM) activated with bivalent europium, the fluorescent component which emits light in the wavelength band of 540 to 560 nm comprises lanthanum phosphate (LAP) activated with cerium and terbium, the fluorescent component which emits light in the wavelength band of 600 to 620 nm comprises yttrium oxide (YOX) activated with trivalent europium, and the fluorescent component which emits light in the wavelength band of 700 to 800 nm comprises lithium aluminate (ALF) activated with iron, and wherein the fluorescent layer has a composition of 10% by weight BAM, 20% by weight LAP, 20% by weight YOX and 50% by weight ALF.

3. A fluorescent lamp, comprising:

a tube having an inner surface; and a fluorescent layer formed on the inner surface of the tube and comprising four fluorescent components having light emission peaks in bands of 440 to 460 nm, 540 to 560 nm, 600 to 620 nm and 700 to 800 nm, respectively, said fluorescent layer having a PF ratio ranging from 0.8 to 1.0, wherein the photon flux PF ratio is a ratio between a photon flux PF contained in the wavelength band of 600 to 700 nm to a photon flux PF contained in the wavelength zone of 700 to 800 nm.

* * * * *